US005163260A

United States Patent [19]

Ricard et al.

[11] Patent Number: 5,163,260

[45] Date of Patent: Nov. 17, 1992

[54] MULTI-PANEL MODULAR SHUTTER ASSEMBLY

[75] Inventors: Michael J. Ricard, Prospect Heights, Ill.; Alan MacGowan, Walworth, Wis.

[73] Assignee: Selfix, Inc., Chicago, Ill.

[21] Appl. No.: 661,897

[22] Filed: Feb. 27, 1991

[51] Int. Cl.[5] ..... E06B 7/08

[52] U.S. Cl. ..... 52/473

[58] Field of Search ..... 52/473, 455–459; 98/121.1; 49/74–77

[56] References Cited

U.S. PATENT DOCUMENTS

| | | | |
|---|---|---|---|
| 165,812 | 7/1875 | Fletcher | 49/75 |
| 1,580,754 | 4/1926 | Mularcik | 52/456 |
| 1,701,695 | 2/1929 | Paine | 49/74 |
| 1,771,304 | 7/1930 | McGruder | 52/455 |
| 2,484,769 | 10/1949 | Wolters | 52/473 |
| 3,055,467 | 9/1962 | Peek et al. | 52/473 |
| 3,086,442 | 4/1963 | Waldron | 52/473 |
| 3,158,909 | 12/1964 | Downs . | |
| 3,191,242 | 6/1965 | Rauen | 52/473 |
| 3,394,518 | 7/1968 | Worrell, Jr. | 52/473 |
| 3,455,079 | 7/1969 | Frederick | 52/473 |
| 3,548,555 | 10/1969 | Trostle et al. | 52/473 |
| 3,797,186 | 3/1974 | Smith | 52/314 |
| 3,802,146 | 4/1974 | Tacke et al. | 52/489 |
| 3,936,985 | 2/1976 | Marulli | 52/660 |
| 3,968,738 | 7/1976 | Matzke | 52/473 |
| 4,251,966 | 2/1981 | Foltman | 52/309.1 |
| 4,765,110 | 8/1988 | Macleod | 52/473 |
| 4,967,511 | 11/1990 | Werginz et al. | 49/371 |

FOREIGN PATENT DOCUMENTS

| | | | |
|---|---|---|---|
| 9990 | 6/1880 | Fed. Rep. of Germany | 52/473 |
| 792951 | 11/1935 | France | 52/473 |

*Primary Examiner*—James L. Ridgill, Jr.
*Attorney, Agent, or Firm*—Dressler, Goldsmith, Shore, Sutker & Milnamow, Ltd.

[57] ABSTRACT

A multi-panel modular shutter assembly comprised of a plurality of center panels disposed side-by-side between a pair of side rails which include retaining means engagable with the adjacent sides of a center panel for retaining said center panel in place and including a plurality of top and bottom rails for framing said center panels engagable with said side rails and an elongate stabilizing strip disposed between adjacent center panels and end rails for retaining said center panels in place and providing a stable shutter assembly.

11 Claims, 1 Drawing Sheet

Fig. 1
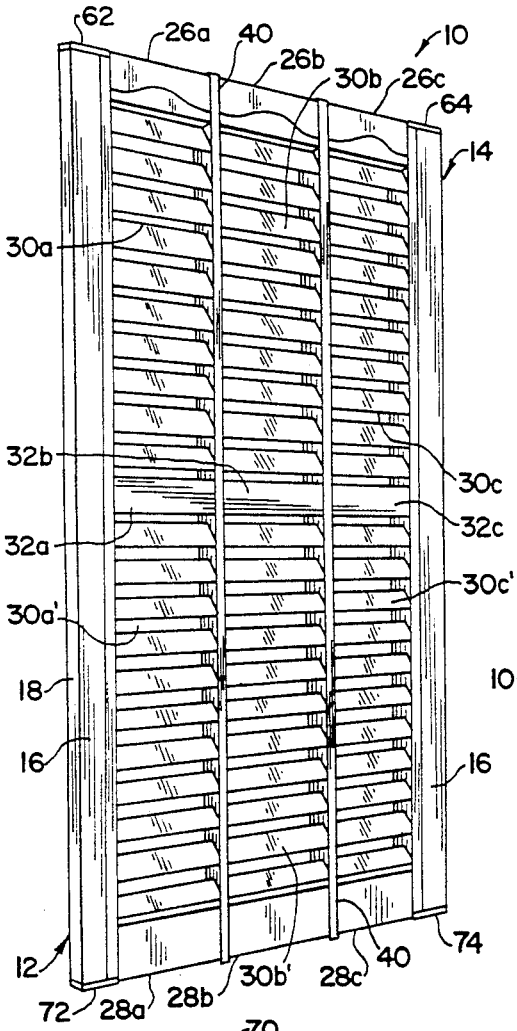
Fig. 2
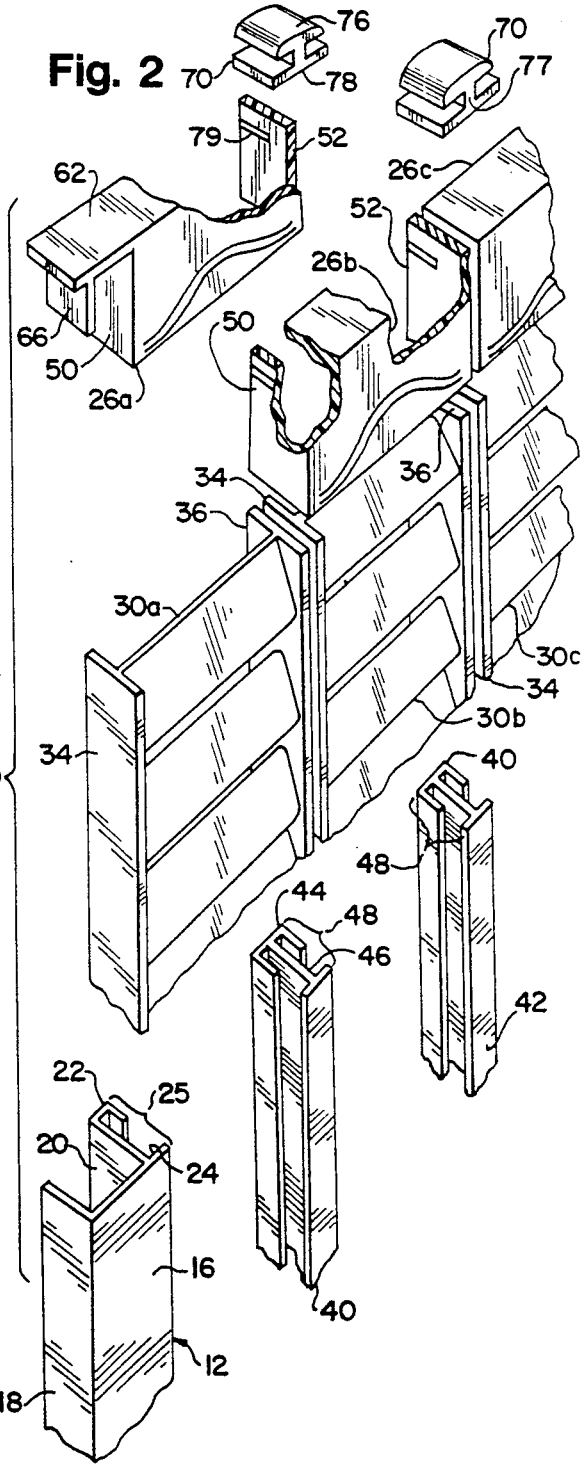
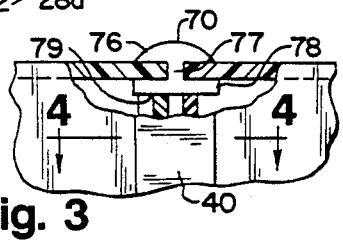
Fig. 3
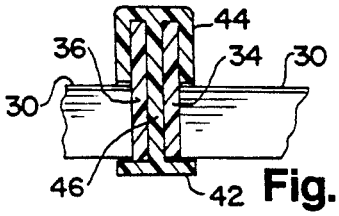
Fig. 4

MULTI-PANEL MODULAR SHUTTER ASSEMBLY

FIELD OF THE INVENTION

This invention pertains to building shutters, and more particularly, to adjustable modular shutter assemblies having a multiple panel.

BACKGROUND OF THE INVENTION

As is well known, there are various decorative building shutters designed to be installed next to building openings, such as windows. Such shutters may be constructed from a variety of materials. While many shutters are constructed as integral units, shutters assembled from modular components provide a degree of flexibility not available with the one-piece units. The length and width of such modular shutter assemblies may be varied to desirably match the size of the opening to which it is to be installed.

An example of such a modular adjustable shutter assembly constructed of plastic is shown in Foltman U.S. Pat. No. 4,251,966. The shutters disclosed in the aforementioned Foltman patent are representative of the general arrangement of components in adjustable modular shutter assemblies. Such shutter assemblies are constructed with a pair of side rails, top and bottom rails, one or more center panels that may take the form of louvers or raised panels. Depending upon its size and style, the shutter may include a center rail or center mullion disposed between adjacent upper panels and lower panels. In such assemblies, the top rail, center panels, center rail and bottom rail are captured and retained in place between the side rails with the top and bottom rails having laterally extending wings that overlie the upper and bottom edges, respectively, of the side rails. The wings may include projections or flanges that extend into the ends of the side rails and braces for maintaining the positional relationships of the components.

The length of such modular shutter assemblies is selected by varying the length of the side rails, and by varying the length of the center panels, e.g., the louver panels, inserted between the side rails. In addition, for longer shutter assemblies, the height of the top and bottom rails as well as the center mullion rail may be increased.

The width of the shutter assemblies is also adjustable by use of center panels having different widths. The widths of the top, bottom, and center rails inserted between the side rails of the shutter assembly are also changed. Thus, the width of a shutter is changed by using panels, top rails, center rails, and bottom rails of different discrete widths. The length of each of these shutter assemblies may be adjusted by varying the length of the side rails and the center panels, e.g., by cutting or trimming the side rails and the center panels to the desired length.

In spite of the degree of flexibility which has been obtained by use of such modular shutter assemblies, such assemblies utilize a single center panel located between and connected to the side rails. A plurality of such panels may be stacked one on top of the other to produce a shutter assemblies of different lengths. While shutter assemblies of varying widths have been produced by using center panels of different widths, the number of different center panels are limited. Furthermore, the ability to vary the appearance and configuration of the shutters is also limited by the use of a single center panel between the side rails.

It would be desirable, therefore, to be able to produce and assemble modular shutter assemblies having varying appearances and varying widths not limited in size by the size of individual center panels themselves. Such structures would provide even additional flexibility in the design construction and appearance of modular shutter assemblies.

SUMMARY OF THE INVENTION

In accordance with the present invention, there is provided a modular shutter assembly having multiple center or louver panels disposed side-by-side between, and captured by, side rails and framed by plural top rails, plural bottom rails, and where desired plural center rails. A multi-panel modular shutter assembly in accordance with the present invention includes modular components, typically formed from a plastic material, e.g., polypropylene or styrene. Such components may be molded or extruded and include a pair of side rails and a plurality of side-by-side interconnected center panels disposed therebetween and framed at opposite ends by a plurality of end rails.

Each of the end rails may be substantially identical. Alternatively, the top end rails and the bottom end rails may be somewhat different in appearance and height. Each of the end rails is normally configured with a pair of detachable or severable wings extending laterally from each side thereof with selected wings being severed to facilitate the use of end rails in the multi-panel modular shutter assembly of the present invention.

When an end rail is used at the end of a center panel which is adjacent to one of the side rails, only one of the severable wings is used. The other wings, remote from the side rail, is severed or detached therefrom. If an end rail is positioned at the end of a center panel which does not abut and connect to either of the side rails, both of the detachable or severable wing portions are severed from the end rail.

Each of the adjacent center panels and end rails are connected together by an elongate stabilizing rail for retaining the adjacent center panels and end rails in position between the side rails.

Thus, in accordance with the present invention, there is provided a multi-panel modular shutter assembly in which a plurality of center panels can be arranged side-by-side between and enclosed by a pair of side rails and framed between top and bottom rails Typically, the end rails are those designed for use with a single panel shutter assembly and have a pair of detachable or severable wings on each side thereof. Selected ones of the wings are severed for facilitating construction of the shutter assembly. One or more end stabilizing clips can be inserted between adjacent end rails to further stabilize the shutter system of the present invention.

The elongated stabilizing rails utilized in the shutter assembly of the present invention include decorative planar front portions for capturing and covering the exposed edges or runners of each of the center panels and end members and appropriately shaped rear retaining hook portions engagable with the sides or runners of the center panels and end members for retaining the panels in place and facilitating stabilization of the entire assembly.

Numerous other features and advantages of the present invention will become readily apparent from the following detailed description of the invention and an embodiment thereof, from the claims, and from the accompanying drawings in which the details of the invention are fully and completely disclosed as a part of this specification.

BRIEF DESCRIPTION OF THE DRAWINGS

FIG. 1 is a perspective view of a multi-panel shutter assembly incorporating the present invention;

FIG. 2 is a partial enlarged exploded view showing the various components thereof;

FIG. 3 is an enlarged partial front view showing a stabilizing clip; and

FIG. 4 is a sectional view taken along line 4—4 of FIG. 3 showing a stabilizing member thereof.

DETAILED DESCRIPTION OF THE PREFERRED EMBODIMENT

While the present invention is susceptible of embodiment in various forms, there is shown in the drawings, and will hereinafter be described, a preferred embodiment of the invention with the understanding that the present disclosure is to be considered as an exemplification of the principles of the invention and is not intended to limit the invention to the specific embodiment illustrated.

As shown in the drawing, the multi-panel modular shutter assembly 10 is comprised of a plurality of modular members including left side rail 12 and right side rail 14. The side rails 12, 14 are substantially identical to each other. For convenience, only left side rail 12 will be described in detail. The side rail 12 has a front wall 16, an outer side wall 18, and an inner side wall 20. Both sidewalls 18, 20 extend rearwardly from the front wall 16. The inner side wall 20 terminates in a rear hooked shaped retaining portion 22. The front wall 16 of side rail 12, also includes a generally planar retaining portion 24 extending inwardly from the inner side wall 20 which defines with the rear retaining portion 22 a mounting channel 25 for receiving and retaining the other components of the shutter assembly 10, including top rails 26 (shown in the drawing as top rails 26*a*, 26*b*, and 26*c*), bottom rails 28 (shown in the drawing as bottom rails 28*a*, 28*b*, and 28*c*), center panels 30 (shown in the drawing as upper center panels 30*a*, 30*b*, 30*c*, and lower center panels 30*a*′, 30*b*′, and 30*c*′), and center rails 32 (shown in the drawing as center rails 32*a*, 32*b*, and 32*c*).

The mounting channel 25 formed on each of the side rails 12, 14 is designed to slidably receive and retain one of the side runners 34, 36 of a center panel member 30, shown in the drawing in the form of a louver member having a plurality of louvers extending between the runners. As indicated above, in the shutter assembly of the present invention, a plurality of upper center panel members 30*a*, 30*b*, 30*c* are disposed side by side between a plurality of top rails 26*a*, 26*b*, 26*c* and a plurality of center rails 32*a*, 32*b*, 32*c*, respectively. A plurality of lower center panel members 30*a*′, 30*b*′, 30*c*′ are disposed side-by-side between the center rails 31*a*, 31*b*, 31*c* and a plurality of bottom rails 28*a*, 28*b*, 28*c*, respectively.

The runners 34, 36 of the outermost upper center panel members 30*a*, 30*c* and of the outermost lower center panel members 30*a*′, 30*c*′ are received in the mounting channels 25 of the side rails 12, 14, as is evident from FIG. 2. The other runners 34, 36 of the center panels are retained in place by elongated T-shaped stabilizing rails 40 disposed therebetween. The stabilizing rails 40 are identical and each includes a forward, planar portion 42 and generally U-shaped hook portion 44 interconnected by a center web 46 together defining a pair of retaining channels 48 on opposite sides of the center web 46. Each of the stabilizing members 40 slidably receives and retains a runner 34 or 36 of a center panel member 30 in one of the channels 48 for stabilizing the assembly of adjacent center panels retained between the side rails 12, 14. The top rails 26 are substantially identical and each has side runner portions 50, 52 and front wall portion 53. The bottom rails 28 are substantially identical to each other and with the top rails (except for some decorative enhancements) and each has substantially identical side runner portions (not shown). The center rails 32 are identical to each other and with the top and bottom rails and each also has substantially the same side runner portions as the top rail runner portions 50, 52. As shown in the aforementioned Foltman patent (as evident from FIG. 2), all of these side runner portions are receivable in the mounting channels 25 of the side rails 12, 14. The side runner portions are also receivable in the channels 48 of the stabilizing rails 40, which are substantially the same in shape and configuration as the channels 25, as shown in FIG. 2. The slidable engagement of the runner portions 34 and 36 of the central panel members 20 is shown in FIG. 4. The side runner portion 50, 52 of top rails 26 and the corresponding substantially identical side rail portions of the bottom rails 28 and the center rails 32 are also receivable in the channels 25 and 48 in the same manner as are the side rails runners 34 and 36 as is evident from the drawing.

The upper end of the shutter assembly 10 is framed by the plurality of top rails 26. The top rails 26 are substantially identical to each other extending laterally outwardly and include severable or detachable wing portions 62, 64 at from either side thereof. The wing portions 62, 64 are designed to cover the exposed ends of the side rails 12, 14, respectively. Each of the wings has a flange 66 which is insertable into the open end of the side rails 12, 14. As is well known, bracing members (not forming part of the present invention and omitted for clarity) may be used. The upper surface of the wings 62, 64 are typically designed to extend over the exposed edges of the side rails 12, 14 for producing a finished looking product.

The wings 62, 64 of the top rails 26 that do not extend over adjacent side rails are removed or severed to allow for positioning of top rails adjacent to each other. The bottom edge of each of the top rails 26 abuts the upper edge of a corresponding upper center panel 30. The adjacent edges of the top rails from which the wings have been removed may be interconnected by an end rail stabilizing clip 70 receivable therebetween. The clip 70 includes a decorative outer portion 76, a transverse web 77, and a lower flange portion 78. The web 77 is positioned in the space between adjacent end rails, with the lower flanged portion 78 passing through a slot 79 formed in the side runner portions 50, 52 of the end rails as is evident from FIG. 3.

The lower end of the shutter assembly 10 is framed by a plurality of bottom rails 28. The bottom rails 28 are similar to the top rails 26 and may be identical thereto. It is recognized that for some shutter assemblies, the appearance and shape of the bottom rails may differ from the top rails as indicated in the drawing.

The bottom rails 28 are substantially identical to each other and include severable or detachable wing portions 72, 74 extending laterally outwardly from either side thereof. The wing portions 72, 74 on each of the bottom rails 28 are substantially identical to the wing portions 62, 64 of the top rails 26 and cover the exposed ends of the side rails 12, 14. The wings 72, 74 have flanges insertable into the exposed bottom ends of the side rails as described above.

The wings that do not extend over adjacent side rails are severed to allow for positioning of bottom rails adjacent to each other. Bottom rail runner portions are received in the channels 25 of the side rails and channels 48 of the stabilizing rails 40. As is the case with the top rails 70, retaining clips can be inserted between the severed edges of the bottom rails.

Thus, there has been disclosed a multi-panel modular shutter assembly in which a plurality of center panels can be assembled side-by-side and retained between a pair of side rails for producing a shutter assembly having a variety of appearances and dimensional variations not without the necessity of producing thinner panels to fulfill these various dimensional configurations. The adjacent edges of the center panels are retained in position by elongated stabilizing rails that include a decorative planar portion that overlies the side edges of each of the adjacent center panels and includes a rear retaining portion that cooperates to define a mounting channel for receiving the runners of the adjacent center panels. A plurality of end panels having severable wing portions frame the assembly to produce a multi-panel modular shutter assembly capable of being configured in a variety of ways not previously possible.

Center panels for the shutter assembly of the present invention can have different shapes and configurations while being disposed side-by-side as well as one above the other in a transverse stacked configuration, and can produce a variety of shutters having different dimensional configurations as well as different appearances.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A multi-panel modular shutter assembly comprising:

a pair of side rail members each having inner and outer side walls and retaining means associated with said inner side wall;

a selectable number of a plurality of center panel members disposed side-by-side between said side rail members, each of said center panel members having side edge runners extending the length thereof and configured to be slidably receivable in said side rail retaining means;

an elongated stabilizing rail member disposed between adjacent ones of said center panel members, each of said elongated stabilizing rail members including retaining means for slidably receiving and retaining said side edge runners of both of said adjacent center panel means;

said end rail members and said stabilizing rail members extending the entire length of said multi-panel modular shutter assembly; and a plurality of end rail members disposed between adjacent side and stabilizing rail member and at the ends of and framing said center panel members, each of said end rail members having a width corresponding to a center panel member framed thereby, said end rail members having sides slidably receivable in and retained by said side and stabilizing member retaining means.

2. A multi-panel shutter assembly as claimed in claim 1 wherein each of said center panels is a louver panel having a plurality of louvers disposed between and formed integrally with a pair of side edge runners slidably receivable in said side and stabilizing rail member retaining means.

3. A multi-panel modular shutter assembly as claimed in claim 1 wherein said end rail members include a plurality of top end rail members corresponding in number and generally co-extensive in width with each of said center panel members and disposed at the top end thereof.

4. A multi-panel modular shutter assembly as claimed in claim 3 wherein said end rail members include a plurality of bottom end rail members corresponding in and disposed at the bottom end thereof in number and generally co-extensive in width with each of said center panel members and disposed at the bottom end thereof.

5. A multi-panel modular shutter assembly as claimed in claim 1 wherein selected ones of said end rail members includes a wing portion extending laterally outwardly from one side thereof and positionable to cover the end of an adjacent side rail member.

6. A multi-panel modular shutter assembly as claimed in claim 5 wherein each of said rail members includes severable wing portions extending laterally outwardly from both sides thereof; and wherein the facing wing portions of adjacent end rail members are severed therefrom.

7. A multi-panel shutter assembly as claimed in claim 10 wherein said elongate stabilizing rail members include a front generally planar portion and a rear hook portion which cooperate to engage and retain the sides of adjacent center panel members and adjacent end rail members.

8. A multi-panel shutter assembly as claimed in claim 7 wherein said planar front portion of said stabilizing rail means covers the side edges of adjacent center panel means and adjacent end rail means.

9. A multi-panel modular shutter assembly as claimed in claim 1 wherein:

the selected number of center panel members is greater than two; and the outermost center panel members are disposed between one of said side rail members and a stabilizing rail member, and the center panel members disposed between said outermost center panel member are disposed between a pair of stabilizing rail members.

10. A multi-panel modular shutter assembly as claimed in claim 9 wherein:

said end rail members disposed at the ends of said outermost center panels adjacent the ends of said side rail members each includes a wing portion extending laterally outwardly from one side thereof and positionable to cover the end of said adjacent side rail member.

11. A multi-panel modular shutter assembly as claimed in claim 10 wherein:

said end rail wing portions are severable; and the facing wing portions of adjacent end rail members are severed therefrom.

* * * * *

UNITED STATES PATENT AND TRADEMARK OFFICE

CERTIFICATE OF CORRECTION

PATENT NO. : 5,163,260

DATED : November 17, 1992

INVENTOR(S) : Michael J. Ricard and Alan MacGowan

It is certified that error appears in the above-identified patent and that said Letters Patent is hereby corrected as shown below:

Column 4, line 25, "20" should be --30--;

Column 6, line 36, "10" should be --1--.

Signed and Sealed this

Sixteenth Day of November, 1993

*Attest:*

*Attesting Officer*

BRUCE LEHMAN

*Commissioner of Patents and Trademarks*